US005083623A

United States Patent [19]

Barrington

[11] Patent Number: 5,083,623

[45] Date of Patent: Jan. 28, 1992

[54] HYDRAULIC SHOCK ABSORBER

[75] Inventor: Burchus Q. Barrington, Duncan, Okla.

[73] Assignee: Halliburton Company, Duncan, Okla.

[21] Appl. No.: 621,666

[22] Filed: Dec. 3, 1990

[51] Int. Cl.[5] ..... E21B 17/07

[52] U.S. Cl. ..... 175/321; 166/55.1; 166/242; 267/125; 267/137; 464/21

[58] Field of Search ..... 175/321, 4.54; 267/125, 267/137, 140.1; 464/21, 20, 18; 166/55.1, 242

[56] References Cited

U.S. PATENT DOCUMENTS

| | | | |
|---|---|---|---|
| 2,577,599 | 12/1951 | Bethancourt | 73/151 |
| 3,149,490 | 9/1964 | Clements et al. | 73/151 |
| 3,301,410 | 1/1967 | Seay | 213/43 |
| 3,526,284 | 9/1970 | Burge | 464/20 X |
| 3,714,831 | 2/1973 | Quichaud et al. | 73/431 |
| 3,923,105 | 12/1975 | Lands, Jr. | 166/55.1 |
| 4,133,516 | 1/1979 | Jurgens | 175/321 X |
| 4,194,582 | 3/1980 | Ostertag | 267/137 X |
| 4,216,570 | 8/1980 | Farris et al. | 29/434 |
| 4,246,765 | 1/1981 | Zabcik | 464/20 |
| 4,276,947 | 7/1981 | Hebel | 175/321 |
| 4,467,866 | 8/1984 | Vazquez et al. | 166/117.5 |
| 4,502,552 | 3/1985 | Martini | 175/321 X |
| 4,552,230 | 11/1985 | Anderson et al. | 175/321 |
| 4,628,995 | 12/1986 | Young et al. | 166/113 |
| 4,693,317 | 9/1987 | Edwards et al. | 166/378 |
| 4,817,710 | 4/1989 | Edwards et al. | 166/242 |

FOREIGN PATENT DOCUMENTS

| | | | |
|---|---|---|---|
| 1006700 | 3/1983 | U.S.S.R. | 175/321 |
| 2025490 | 1/1980 | United Kingdom | 175/321 |

*Primary Examiner*—Hoang C. Dang
*Attorney, Agent, or Firm*—James R. Duzan; Robert E. Hessin

[57] ABSTRACT

A shock absorber apparatus for inclusion in a tool string which consists of outer and inner casings telescopically assembled with one casing having an uphole threaded joint member and the other casing having a downhole threaded joint member. The concentric casings then define spaced, sealed voids communicating through a metering sleeve clearance that are filled with a compressible oil. Shock wave induced relative movement of the casings from either direction causes a shock absorbing instantaneous displacement of oil from one void to the other via the metering clearance. Alternatively, coil springs may be disposed in the voids to aid in shock absorption.

12 Claims, 2 Drawing Sheets

HYDRAULIC SHOCK ABSORBER

BACKGROUND OF THE INVENTION

1. Field of the Invention

The invention relates generally to shock absorbers for insertion in a drill or tubing string to isolate downhole explosive apparatus and, more particularly, but not by way of limitation, it relates to an improved type of shock absorber for isolating the jarring effect from perforator jets located either upward or downward thereby to protect the delicate instrumentation of the pressure recording gauges.

2. Description of the Prior Art.

A number of shock absorber devices have been devised for isolating vibrations or explosive energy from more sensitive instruments down within an oil well borehole. U.S. Pat. No. 4,817,710 and U.S. Pat. No. 4,693,317, related applications, teach a borehole shock absorber that is used for guarding against both longitudinal and radial shock as it affects a gauge teaching of a shock proof case providing wireline support of an instrument housing assembly through a series of resilient elastomeric isolation pads.

. U.S. Pat. No. 3,714,831 exemplifies the types of device that function to carry a measuring instrument suspended within such as a drill collar section that is designed to receive the instrument. Once again, an elastomeric body or series of annular bodies disposed between the instrument and the drill-collar frame provide reduced vibration suspension of the measuring instrument. This type of device also allows for central passage of drilling fluid through the drill collar simultaneous with sensing operations U.S. Pat. No. 4,628,995 discloses a carrier for supporting pressure gauges on a tool string while providing seating for one or more pressure gauges. This device utilizes a restricted flow passageway that impedes the flow of hydraulic well fluid under the effect of the pressure surge at detonation of a perforator, and subsequent expansion of the fluid pressure in an enlarged bore section damps the pressure surge to safely isolate the pressure-sensitive component.

Therefore, it is an object of the present invention to provide rapid damping of the effects of jet detonation traveling either upward or downward in the tool string.

It is also an object of the invention to provide a shock isolation mechanism that safeguards against shock generation either above or below in the tool string.

It is still another object of the present invention to provide a mechanism for protecting the very delicate instrumentation of pressure recording gauges and the like when perforation jets are detonated.

Finally, it is an object of the present invention to provide a shock absorber that is capable of very rapid displacement and subsequent shock absorption.

Other objects and advantages of the invention will be evident from the following detailed description when read in conjunction with the accompanying drawings which illustrate the invention.

DETAILED DESCRIPTION OF THE INVENTION

Figure 1A:
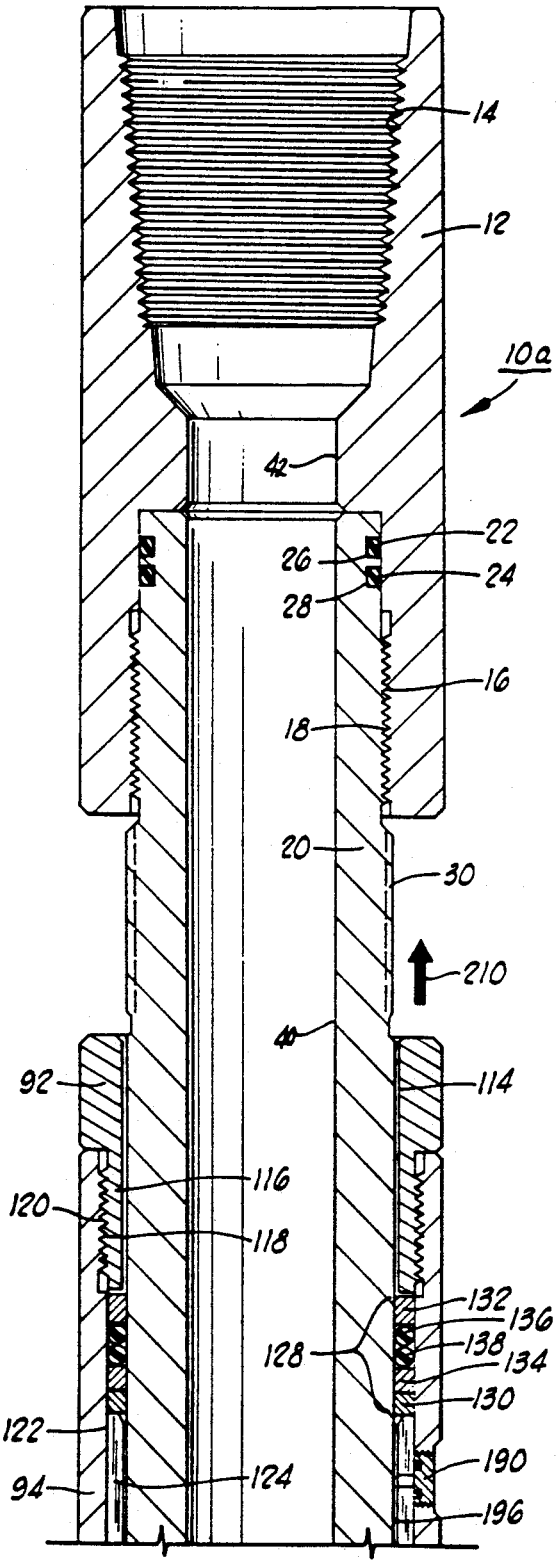
FIG. 1A is a view in vertical section of a top portion of the shock absorber assembly.

FIGS. 1A through ID illustrate a shock absorber assembly 10. The upper end of assembly 10 (FIG. 1A) consists of a box-type cylindrical joint 12 having female joining threads 14. The lower end of cylindrical joint 12 includes an axial, threaded bore 16 for receiving a threaded outer surface 18 of an adaptor sleeve 20 securely therein A pair of elastomer sealing rings 22, 24 seated within annular grooves 26, 28 provide fluid-tight affixture of adaptor sleeve 20 and cylindrical joint 12. A plurality of longitudinal flats formed around the adaptor sleeve 20 to provide a wrench space for tightening connection.

Figure 1B:
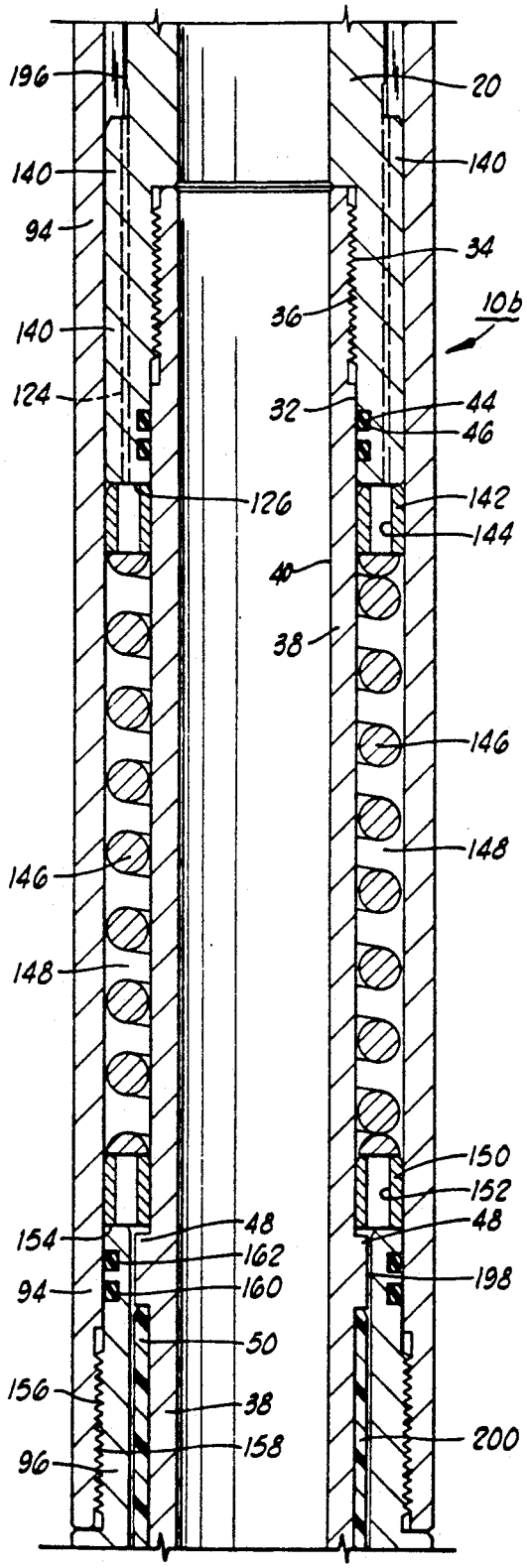
FIG. 1B is a view in vertical section of the upper mid-portion of the shock absorber assembly.

The lower end of sleeve adaptor 20 is formed with an axial bore 32 having threads 34 for receiving outer end threads 36 of a mandrel 38 (see FIG. 1B). The mandrel 38 defines an internal flow way or bore 40 which aligns coaxially with bore 42 of the cylindrical joint 12. Elastomer O-ring seals 44 seated within respective annular grooves 46 provide sealing structure.

Figure 1C:
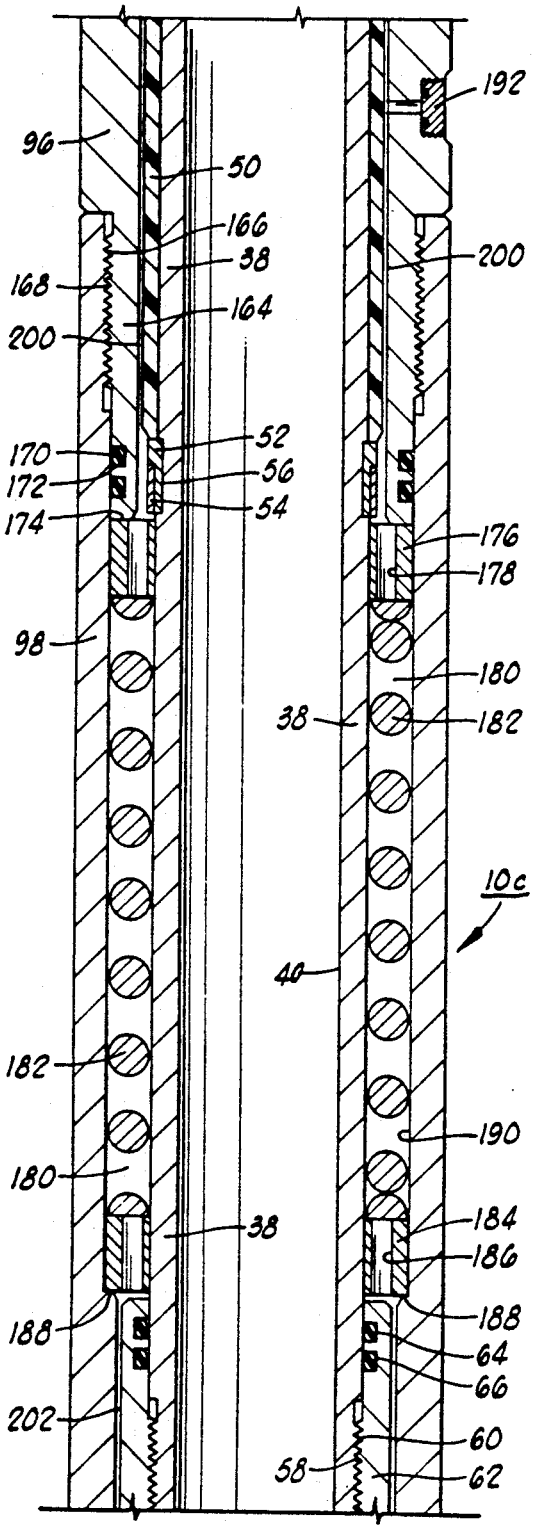
FIG. 1C is a view in vertical section of the lower mid-portion of the assembly.
Figure 1D:
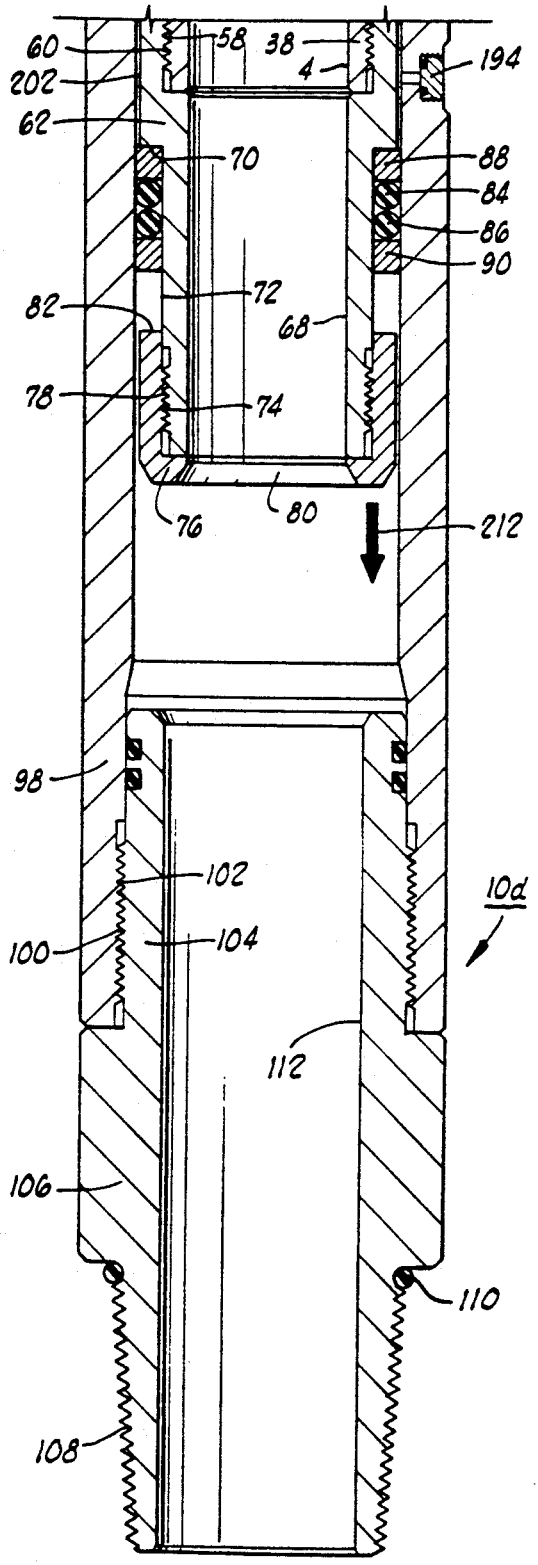
FIG. 1D is a view in vertical section of the lower part of the shock absorber assembly.

An upset annular band 48 is formed around mandrel 38 about mid-length. Band 48 serves as a positioning member retaining one end of a metering sleeve 50. As shown in FIG. 1C, the metering sleeve 50 is retained at the other end by means of a C-ring 52 and locking ring 54 as seated within an annular groove 56 formed in mandrel 38. Referring also to FIG. 1D, the lower end of mandrel 38 is formed with external threads 58 for sealing engagement within internal bore threads 60 of a lower adaptor 62. Fluid-tight affixture of adaptor 62 is assured by the plurality of elastomer O-rings 64 seated within annular grooves 66. Adaptor 62 includes a coaxial bore 64 while the outer cylindrical surface is formed with a downwardly facing annular shoulder 70 to form into a reduced radius outer cylindrical surface 72, the bottom of which has external threads 74 formed thereon. A lower retaining cap 76 having threads 78 is then secured over the lower end of adaptor 62. The cap 76 includes axial opening 80 as an upper annular surface 82 provides abutment for a seal consisting of two elastomer O-rings 84, 86 retained between two square TEFLON ® rings 88 and 90.

Outer casing structure consists of an end cap 92, an upper sleeve 94, an adaptor 96, and a lower sleeve 98. Lower sleeve 98 (FIG. 1D) includes internal threads 100 for receiving threads 102 of a collar 104 extending a pin-type joint structure 106 having male joining threads 108 and suitable sealing ring 110. The joint end 106 defines an axial bore 112 that is concentric with the remaining axial bores 40, 42 through the shock absorber apparatus 10 to allow fluid flow therethrough.

The upper cap 92 includes an inner bore 114 that is slidingly received over adaptor sleeve 20. See FIG. 1A. Cap 92 also extends a collar 116 having threads 118 for secure connection within internal threads 120 of upper sleeve 94. The inside cylindrical wall 122 of upper sleeve 94 extends a plurality of splines 124 radially inward from cylindrical wall 122, the splines 124 extending from a point adjacent the bottom annular surface 126 of sleeve 20 up to a point wherein a sealing space 128 is formed beneath the upper end cap 114. Thus, a square brass ring 130 is slidably received for abutment against the ends of splines 124. A standard type of seal consisting of square TEFLON ® rings 132 and 134 on each side of a pair of elastomer O-rings 136 and 138 fills out the void 128 beneath upper cap 92.

The lower portion of adaptor sleeve 20 (FIG. 1B) includes a circumferential array of lands 140 each of which is disposed to slidably fit between respective ones in the circumferential series of splines 124. The lands 140 may be on the order of three-quarters inch arcuate length with the splines 124 formed to be about one-quarter inch radial dimension. The dimensions of lands 140 and splines 124 are not critical so long as the slidable engagement maintains axial alignment while allowing sufficient torque force exchange.

In FIG. 1B, a perforate annular ring 142 having a plurality of holes 144 therethrough is disposed adjacent the annular surface 126 of adaptor sleeve 20. The perforate ring 142 provides footing for a spring 146 disposed within a circular void 148. The other end of spring 146 is buttressed against a perforate ring 150 having a plurality of equi-spaced holes 152. The perforate ring 150 is supported against the annular surface 154 of adaptor 96 as internal threads 156 of upper sleeve 94 are engaged with adaptor external threads 158 of adaptor 96 as a pair of elastomer O-rings 160 are seated within grooves 162.

Referring to FIG. 1C, a lower collar 164 of adaptor 96 includes external threads 166 which serve for engagement with internal threads 168 of lower sleeve 98. A pair of sealing O-rings 170 seated within grooves 172 provide fluid-tight joinder of lower sleeve 98 to adaptor 96, and lower annular surface 174 of collar 164 provides a seating surface for yet another perforate ring 176 having holes 178. The perforate ring 176 defines a void space 180 in which is disposed a spring 182 as supported on the opposite end by a perforate ring 184 having feed-through holes 186. The perforate ring 184 is further supported by an annular shoulder 188 formed about the inner cylindrical wall 190 of the lower sleeve 98.

The shock absorber apparatus 10 utilizes a suitably compressible oil in certain interior spaces as will be further described below. A particularly desirable oil is silicone oil which exhibits a compressibility between 6½% and 7% at about 10,000 pounds per square inch pressure. This compressibility quotient is in a range that facilitates operation of the present invention. The silicon oil is input to the assembled shock absorber assembly 10 through sealed screw plugs 190 (FIG. 1A), 192 (FIG. 1C), and 194 (FIG. 1D). Filling of oil through these sealed screw plugs places oil in interior spaces such as clearance 196 within upper sleeve 94 and through splines 124, in communication with void 148 via ring holes 144. The flow space extends further through ring holes 152 and clearance space 198 to the metering clearance 200 adjacent the metering sleeve 50 (FIG. 1B). The metering sleeve 50 is formed from a suitable high performance plastic such as RYTON TM and the metering clearance 200 can be adjusted by machining or replacement of sleeves 50 thereby to adjust the rate of oil displacement within the void spaces, depending upon the exigencies of the particular application.

Further flow communication from metering clearance 200 communicates via ring holes 178 through void space 180 and ring holes 186 to a lower sleeve clearance 202 which terminates at the seal combination made up of TEFLON ® rings 88, 90 and O-ring seals 84, 86.

In a present design, the springs 146 and 182 are rated to be 9.69 inches free length with a 1.5 inch preload compression while accounting for a 4 inch travel during shock absorption. There is a 672 pound installation load on the springs in quiescent state and they are compressible at a 448 pounds per inch rate, thus requiring 1790 pounds per 4 inch travel during shock absorption compression. The volume of void space in spring voids 148 and 180 is 63.44 cubic inches and the volume of silicone oil in quiescent state contained with the springs 146, 182 is 37.93 cubic inches including the various clearance spaces.

In operation, the shock absorber apparatus 10 is assembled with a metering sleeve 50 that provides the desire metering clearance positioned adjacent adaptor 96 as other components are assembled to make-up the tool. The interior reservoir spaces are then filled with silicone oil of selected compressibility through the respective sealable screw plugs 190, 192 and 194. In some cases, where lesser violent shock may be encountered, the assembly 10 may be utilized without inclusion of the heavy steel springs 146 and 182. In their place, additional volume of silicone oil is included since the oil compressibility provides sufficiently rapid reaction to absorb up-going or down-going shock.

The tool string may include an absorber assembly 10 at various points along the string, and perforating jets may be located either above or below during detonation. Thus, the jarring effect as transmitted to the tubing may be either up-going or down-going as it creates a tremendous shock wave which sensitive gauges and recorders must endure. Any metering system that is built to handle the instantaneous loads of the shock absorber assembly 10 must be able to meter fast in order to reduce the loading, otherwise the shock absorber will effectively become a rigid member of the tubing string The metering system of assembly 10 is formed between the clearances of the outside diameter of mandrel 38 and the inside diameter of the outer sleeve and adaptor components, and metering tolerance can be adjusted by interchangeability of mandrel parts, particularly the metering sleeve 50.

The shock force generated by the jets' detonation peaks within 0.045 seconds of initiation. Thus, the action of the shock absorber must be very fast in order to be effective. In a first case, with springs 146 and 182 eliminated, the compressibility of the silicone oil load within the reservoir spaces will provide sufficiently fast reaction to absorb the requisite shock. As the shock force affects the shock absorbing apparatus 10, the outer sleeve components tend toward the movement as indicated by major arrow 210 (FIG. 1A) as opposite reaction of the inner or mandrel components moves in the direction of major arrow 212 (FIG. 1D). For an up-going force, the outer sleeve structure including adaptor 96 and upper and lower sleeves 94 and 98 are urged upward in the direction of major arrow 210 and this tends to compress the oil contained within void 180 as released oil is metered through metering clearance 200 into the void 148 thereabove. Thus, the up-going force is effectively cushioned by the compressible oil which then rapidly decompresses to equalize pressures throughout the interior void spaces of shock absorber apparatus 10. The apparatus 10 would function in equal but opposite manner in response to down-going forces in the direction of major arrow 212. Thus, downward relative movement of inner mandrel 38 and associated components would force silicone oil from the upper void space 148 in metered amounts through metering clearance 200 to the lower void space 180 whereupon the components would then assume initial position as the oil pressures equalize.

Inclusion of the springs 146 and 182 within the respective upper and lower void spaces 148 and 180 would tend to provide additional cushioning of initial force so that greater forces can be absorbed by the apparatus 10 with little or no adverse effect to sensitive components along the tool string.

The foregoing discloses a novel form of shock absorber for inclusion in the tool string to isolate intense vibration and shock from sensitive components. The device can be readily assembled with interchangeable components that enable adjustment of spring and spring recovery forces so that the apparatus can be adapted for use in any of a great number of shock absorption situations. In addition, the shock absorber apparatus has the capability of being reactive to jarring shock forces that approach from either end of the apparatus while providing equal isolation.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. Apparatus for absorbing shock vibration along a tool string, comprising:

an outer casing having thread connector on one end for securing into said tool string, and having a cap means on the other end that defines an axial opening;

an inner casing slidably disposed through said axial opening with one end extending coaxially within the outer casing the defining an annular space adjacent thereto, and the other end having a threaded joint connector for securing into said tool string;

metering sleeve means disposed around said inner casing and dividing said annular space into first and second cylindrical voids that are in communication through a predetermined metering clearance;

first and second compression coil springs slidably disposed on the inner casing and aligned in the respective first and second cylindrical voids;

first shoulder means on said inner casing to retain the first coil spring outer end;

second shoulder means on said inner casing to retain the second coil spring outer end;

an adaptor sleeve disposed in said outer casing adjacent said metering sleeve means defining shoulders in retention of respective first and second coil springs means inner ends; and oil of predetermined compressibility filling said first and second cylindrical voids and said metering clearance;

whereby a shock wave traveling along the tool string will cause rapid reciprocation of the outer casing relative to the inner casing with consequent compression exchange of oil between the first and second voids.

2. Apparatus as set forth in claim 1 wherein:

said oil is silicone oil having a pre-selected compressibility.

3. Apparatus as set forth in claim 1 which is further characterized in that:

said outer casing includes upper and lower sleeves sealingly joined by a threaded adaptor sleeve that defines a cylindrical inner wall for disposition adjacent said metering sleeve means.

4. Apparatus as set forth in claim 1 which is further characterized to include:

a plurality of lands formed to extend longitudinally along a portion of the inner casing; and a plurality of splines formed to extend longitudinally along a portion of the outer casing, said splines being slidably retained between respective pairs of lands.

5. Apparatus as set forth in claim 4 which is further characterized in that:

said outer casing includes upper and lower sleeves sealingly joined by a threaded adaptor sleeve that defines a cylindrical inner wall for disposition adjacent said metering sleeve means.

6. Apparatus as set forth in claim 5 wherein:

said oil is silicone oil having a pre-selected compressibility.

7. Apparatus as set forth in claim 1 wherein said outer casing further comprises:

an adaptor sleeve located centrally having first and second ends and having a cylindrical inner wall;

an upper sleeve having upper and lower ends with the lower end sealingly secured to the adaptor first end;

said cap means is sealingly secured to the upper sleeve upper end and defining a central bore through which the inner casing is closely received;

a lower sleeve having upper and lower ends with the upper end sealingly secured to the adaptor second end; and tool joint connector means threadedly connected to said lower sleeve lower end.

8. Apparatus as set forth in claim 1 wherein said inner casing further comprises:

said threaded joint connector having a threaded lower collar;

an adaptor sleeve having upper and lower ends with the upper end sealingly secured in the joint connector lower collar, and the lower end closely received through said cap means axial opening outer casing and defining said first shoulder means;

a mandrel defining an axial bore and having upper and lower ends with the upper end sealingly secured in said adaptor sleeve lower end, said mandrel having an annular band and spaced annular locking ring formed generally centrally thereon for maintaining said metering sleeve means; and lower cap means threadedly received over the mandrel lower end with the cap means periphery closely slidable within the outer casing proximate the thread connector at one end, and defining said second shoulder means.

9. Apparatus as set forth in claim 7 wherein said inner casing further comprises:

said threaded joint connector having a threaded lower collar;

an adaptor sleeve having upper and lower ends with the upper end sealingly secured in the joint connector lower collar, and the lower end closely received through said cap means axial opening of said outer casing, and defining said first shoulder means;

a mandrel defining an axial bore and having upper and lower ends with the upper end sealingly secured in said adaptor sleeve lower end, said mandrel having an annular band and spaced annular locking ring formed generally centrally thereon for maintaining said metering sleeve means; and lower cap means threadedly received over the mandrel lower end with the cap means periphery closely slidable within the outer casing proximate the thread connector at one end, and defining said second shoulder means.

10. Apparatus as set forth in claim 8 which is further characterized in that:

said mandrel defines first and second cylindrical voids relative to the outer casing.

11. Apparatus for inclusion in a tool string for absorbing shock waves traveling therealong, comprising:

an outer casing having a tool string connector on one end and cap defining an axial bore on the other end with the inside cylindrical wall of the outer casing forming a central metering wall of first diameter and first and second reservoir walls of increased diameter on each side thereof, and upper and lower cylindrical walls of reduced diameter on each side of the respective reservoir walls;

an inner casing having a tool string connector on one end with the other end slidingly received through the cap axial bore and within the inside cylindrical wall of the outer casing, and including a metering sleeve in juxtaposition to said outer casing metering wall with pre-selected clearance, and first and second cylindrical voids formed on each side of the metering sleeve adjacent the respective first and second reservoir walls;

first and second sealing means disposed between the outer casing and inner casing at the one end and the other end of said casings;

first and second compression coil springs each aligned in a respective one of said first and second cylindrical voids;

first, second, third and fourth shoulder means formed along and movable with said inner casing and spaced for positive engagement with each end of both said first and second compression coil springs; and a suitable oil of pre-selected compressibility filling the first and second cylindrical voids and the metering space therebetween;

whereby a shock wave traveling along the tool string will cause rapid reciprocation of the outer casing relative to the inner casing with consequent compressive exchange of oil between the first and second cylindrical voids.

12. Apparatus as set forth in claim 11 wherein:

said oil is silicone oil having predetermined compressibility.

* * * * *